United States Patent [19]

Gagliardo

[11] 4,030,666

[45] June 21, 1977

[54] FIRE FIGHTING NOZZLE

[75] Inventor: John P. Gagliardo, Shrewsbury, Mass.

[73] Assignee: Feecon Corporation, Westborough, Mass.

[22] Filed: Jan. 22, 1976

[21] Appl. No.: 651,290

[52] U.S. Cl. ..... 239/526; 251/25

[51] Int. Cl.[2] ..... B05B 11/02

[58] Field of Search ..... 239/526, 570, 583; 251/25

[56] References Cited

UNITED STATES PATENTS

| | | | |
|---|---|---|---|
| 2,445,163 | 7/1948 | Williamson | 251/25 |
| 2,627,873 | 2/1953 | Bothe | 251/25 |
| 2,805,037 | 9/1957 | Bruce | 251/25 |
| 3,055,629 | 9/1962 | Jurs et al. | 251/25 |
| 3,633,828 | 1/1972 | Larson | 239/526 X |

*Primary Examiner*—Evon C. Blunk
*Assistant Examiner*—Michael Mar
*Attorney, Agent, or Firm*—Norman S. Blodgett; Gerry A. Blodgett

[57] ABSTRACT

Fire fighting nozzle having a hard grip containing a bottom-actuated pilot valve which admits small amounts of a fluid under pressure to a main fluid valve to control its operation to regulate large flows of the fluid.

20 Claims, 6 Drawing Figures

FIRE FIGHTING NOZZLE

BACKGROUND OF THE INVENTION

Traditionally, fire fighting apparatus consisted of a flexible hose connected to a source of pressure fluid at one end and at the other end to a nozzle, wherein the flow of fluid could be shut off by a simple valve located at the nozzle. Recently, however, there has been a demand for a more easily operated valve located at the nozzle and this has been brought about by a change in the nature of fire fighting. For one thing, there has been a tendency to mount the nozzle on the upper part of a piece of mobile equipment and to make available to the fire fighter a number of fire extinguishing media. It is common practice, for instance, to supply to the nozzle water (on the one hand) and a gas-propelled powder (on the other hand). By providing the valving at the nozzle, it has been possible for the fire fighter to select the proper medium and to apply the fire extinguishing medium in short bursts, if necessary. Considerable power is required to operate simple valves and this is not only tiring, but also reduces the sensitivity of the control. Various means, of course, are available to operate simple valves, but, generally speaking, they require the use of either a lever which requires two hands for operation, or a lever arranged as a squeeze grip which can be tiring, as well as introducing delicate equipment into a less-than-ideal environment. These and other difficulties experienced with the prior art devices have been obviated in a novel manner by the present invention.

It is, therefore, an outstanding object of the invention to provide a fire fighting nozzle in which the opening and closing of the main fluid valve takes place under finger control.

Another object of this invention is the provision of a fire fighting nozzle whose main valve is operated by the fluid which it controls.

A further object of the present invention is the provision of a fire fighting nozzle in which the main valve is controlled by a pilot valve and in which no accessory operating fluid or medium is necessary.

It is another object of the instant invention to provide a fire fighting nozzle which is pilot valve controlled, which is simple and rugged in construction, and which is capable of a long life of useful service.

A still further object of the invention is the provision of a fire fighting nozzle making use of a plurality of fire extinguishing media in which each medium is provided with its own actuating button, each button making use of its own medium to control its own main valve.

With these and other objects in view, as will be apparent to those skilled in the art, the invention resides in the combination of parts set forth in the specification and covered by the claims appended hereto.

SUMMARY OF THE INVENTION

In general, the invention consists of a fire fighting nozzle having a housing from which extends a hand grip. A pilot valve is mounted in the hand grip with an actuating button extending from the hand grip in position for operation by a finger. Inlet and outlet openings are provided in the housing and a main valve is located in the housing between the openings. Passages connect the inlet opening to the pilot valve and to the main valve. The pilot valve normally causes fluid from the inlet opening to maintain the main valve in a first condition, in which fluid cannot pass from the inlet opening to the outlet opening. On occasion, the pilot valve allows the main valve to move to a second condition at which fluid is allowed to pass from the inlet opening to the outlet opening.

More specifically, the main valve consists of an axially-slidable piston having a first end of small area engaging a valve seat and a second end of relatively large area to which fluid from the inlet opening is admitted by the pilot valve.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
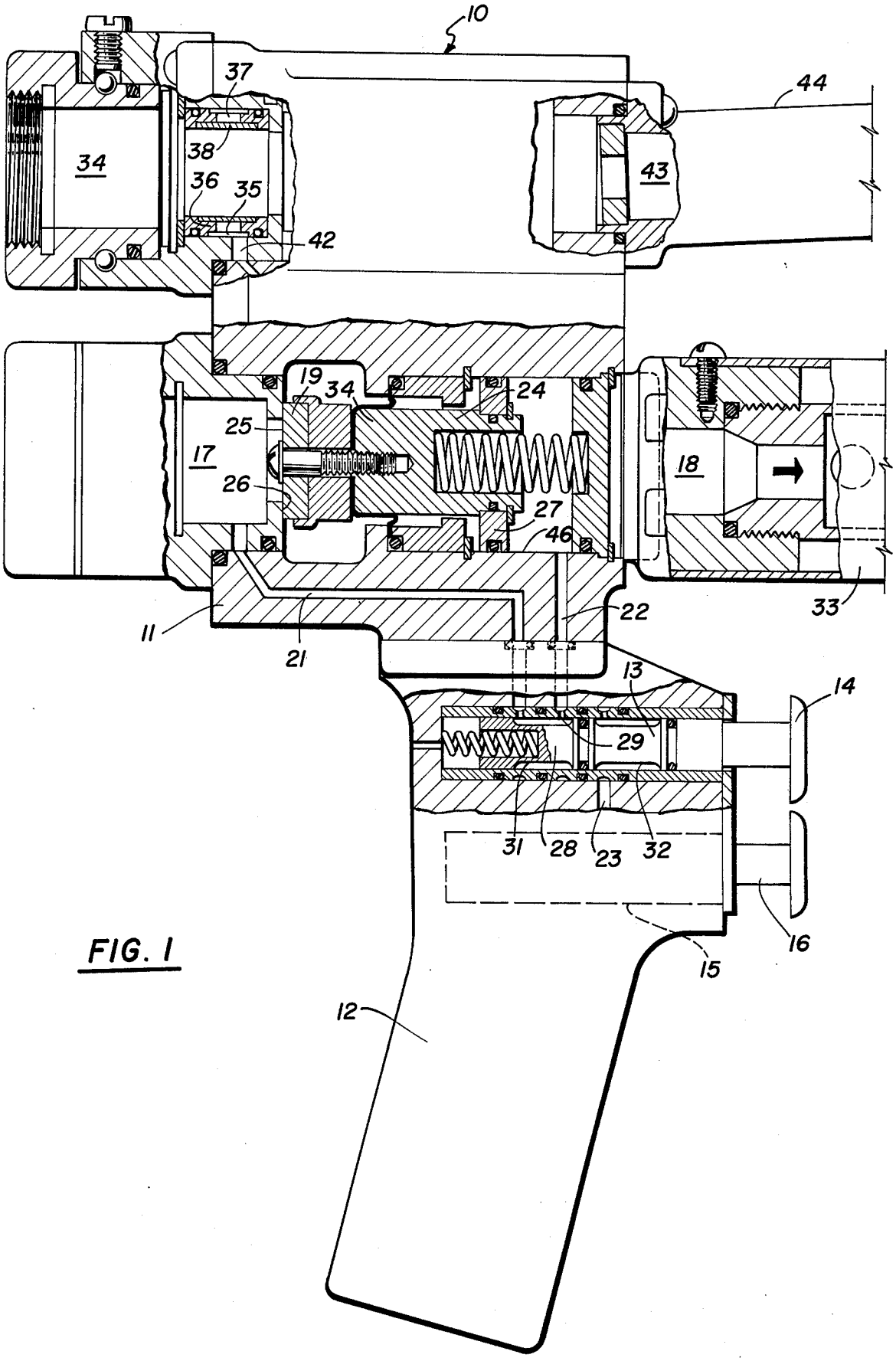
FIG. 1 is a vertical sectional view of a fire fighting nozzle embodying the principles of the present invention.

Referring first to FIG. 1, wherein are best shown the general features of the invention, the fire fighting nozzle, indicated generally by the reference numeral 10 is shown as having a housing 11 from which extends a hand grip 12. A pilot valve 13 is mounted in the hand grip and is provided with an actuating button 14 which extends from the grip in position to be operated by a finger. A second pilot valve 15 resides in the hand grip and its actuating button 16 extends from the hand grip closely adjacent to the button 14. The housing 11 is provided with an inlet opening 17 and an outlet opening 18 between which lies a main valve 19. A passage 21 extends through the housing 11 and the hand grip 12 to the pilot valve 13. A second passage 22 extends from the pilot valve 13 to the main valve 19. A third passage 23 extends from the pilot valve 13 to the exterior of the hand grip 12.

The pilot valve normally causes pressure fluid from the inlet opening 17 to maintain the main valve in a first condition, wherein fluid cannot pass from the inlet opening to the outlet opening. The pilot valve on occasion allows the main valve to move to a second condition wherein fluid is allowed to move from the inlet opening to the outlet opening.

The main valve 19 comprises an axially-slidable piston 24 having a first end 25 with a small area engaging a valve seat 26 and a second end 27 of relatively large area to which the fluid from the inlet opening 17 is admitted by the pilot valve 13.

The pilot valve 13 consists of a spindle 28 slidably carried in a bore 29 formed in the hand grip 12. The spindle extends from the bore and from the grip to be fastened to the actuating button 14. The first passage 21 extends from the inlet opening 17 in the housing to the bore 29, while the second passage 22 extends from the bore to the said second end 27 of the piston and while the third passage 23 extends from the bore 29 to the exterior of the grip.

The pilot valve spindle 28 has two axially-spaced reduced portions 31 and 32. One of the reduced portions bridges the first passage 21 and the second passage 22 when the pilot valve is in its normal condition, while the other reduced portion 32 bridges the second passage 22 and the third passage 23 when the pilot valve has its button depressed. A tubular fluid distributor 33 extends from the outlet opening 18 of the housing 11 in a direction generally perpendicular to the hand grip 12.

A secondary inlet opening 34 receives a mixture of powder and a propellant gas. A groove 35 is separated from the inlet opening 34 by a separating element 36 which covers the groove. This element consists of a sleeve 37 having large apertures covered by a tubular screen 38 having relatively small apertures.

Figure 2:
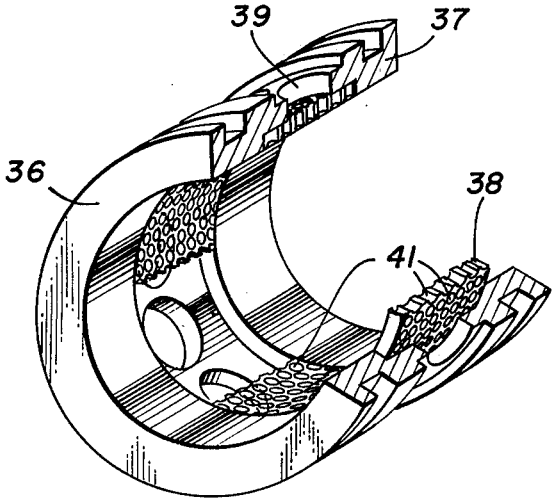
FIG. 2 is a perspective view with portions broken away of an element of the nozzle.

FIG. 2 shows the nature of the separating element 36 with its sleeve 37 and its screen 38. The drawing shows the large apertures 39 in the sleeve which lead to the groove 35 and the small apertures 41 in the screen.

Figure 3:
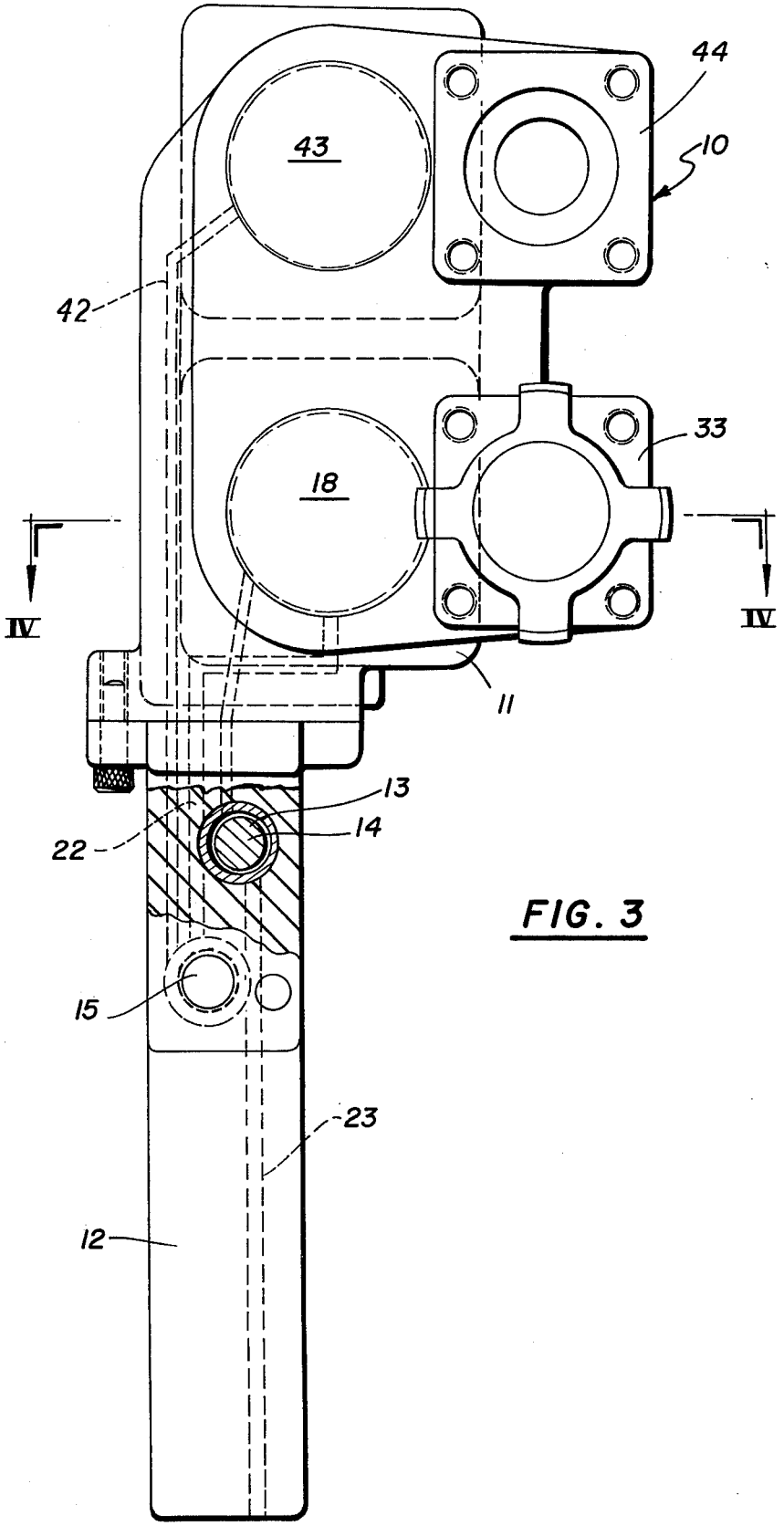
FIG. 3 is an end elevational view of the nozzle.

To take care of this mixture of powder and propellant gas another set of inlet and outlet openings along with a main valve are located in the housing and spaced in a generally-parallel relationship to the inlet opening 17. The second inlet opening 34 has already been mentioned, and in FIG. 3 it can be seen that a passage 42 leads from the inlet opening 34 to the pilot valve 15. The passage 23 to the exterior of the hand grip 12 is shared both by the pilot valve 13 and the pilot valve 15. A pressure-fluid passage (not shown), which is similar in nature to the passage 22, extends from the pilot valve 15 to the second main valve associated with the outlet opening of the upper gun 44.

Figure 4:
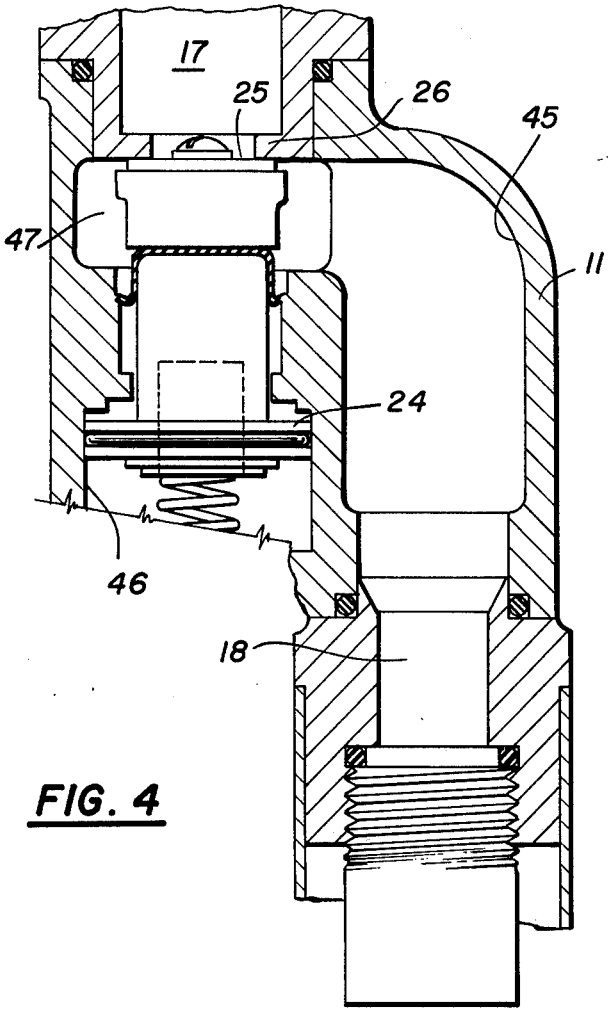
FIG. 4 is a sectional view of the nozzle taken on the line IV—IV of FIG. 3, and FIGS. 5 and 6 are schematic views of operative portions of the nozzle showing their relationships in two different conditions.

FIG. 4 shows the manner in which fluid from the inlet opening 17 is carried to the outlet opening 18 by an L-shaped chamber 45. It is evident in FIG. 4 that the piston 24 is slidable in a bore 46 in the housing.

Figure 5:
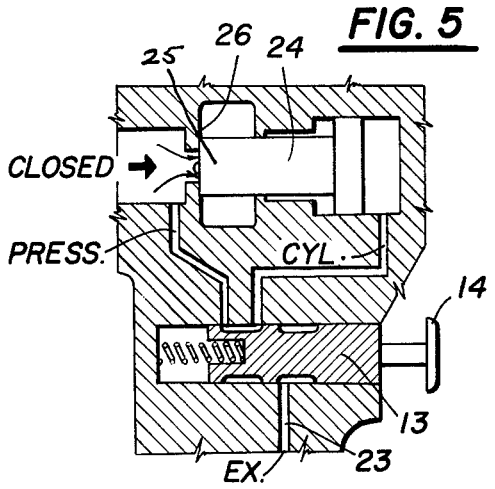
Figure 6:
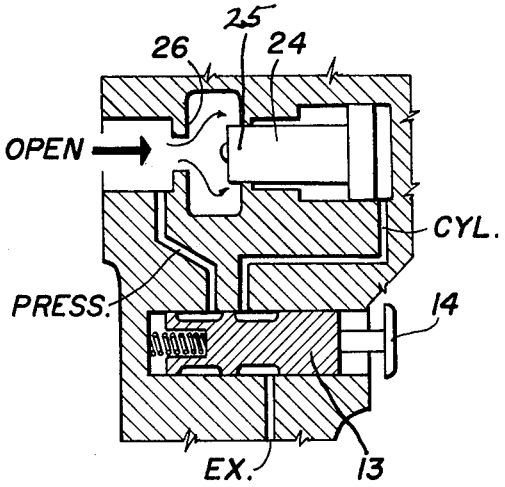

FIGS. 5 and 6 show schematically the manner in which the apparatus operates. FIG. 5 shows the normal position with the first end 25 pressed against the valve seat so that no flow of fluid can take place. In FIG. 6 with the button 14 pressed, the spindle of the pilot valve 13 is moved to the left and allows fluid flow to take place in the gap between the first end 25 and the valve seat 26. A similar operation takes place when he button 16 is pressed except that it is the material originating in the inlet opening 34 that flows from the gun 44.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Fire fighting nozzle, comprising
a. a housing,
b. a hand grip extending from the housing,
c. a pilot valve mounted in the hand grip with an actuating button extending from the hand grip in position for operation by a finger, the pilot valve consisting of a spindle slidably carried in a bore in the hand grip, the spindle extending from the bore and from the grip to constitute the said actuating button,
d. an inlet opening in the housing,
e. an outlet opening in the housing,
f. a main valve located in the housing, the main valve comprising an axially-slidable piston having a first end of small area engaging a valve seat and a second end of relatively large area to which fluid from the inlet opening is admitted by the pilot valve, and
g. passages connecting the inlet opening to the pilot valve and to the main valve, the pilot valve normally causing fluid from the inlet opening to maintain the main valve in a first condition wherein fluid cannot pass from the inlet opening to the outlet opening, the pilot valve on occasion allowing the main valve to move to a second condition wherein fluid is allowed to pass from the inlet opening to the outlet opening, a first passage extending from the inlet opening in the housing to the bore in the grip, a second passage extending from the bore in the grip to the said second end of the piston, and a third passage extending from the bore in the grip to the exterior of the grip, the pilot valve spindle having two axially-spaced reduced portions one of the reduced portions bridging the first and second passages when the pilot valve is in its normal condition, while the other reduced portion bridges the second and third passages when the pilot valve has its button depressed.

2. Fire fighting nozzle as recited in claim 1, wherein a tubular fluid distributor extends from the outlet opening of the housing in a direction generally perpendicular to the grip.

3. Fire fighting nozzle as recited in claim 1, wherein another set of inlet and outlet openings with a main valve is located in the housing in spaced, generally-parallel relationship to the aforementioned inlet opening, outlet opening, and main valve, and wherein a second pilot valve is mounted in the hand grip with its actuating button located adjacent the aforementioned actuating button.

4. Fire fighting nozzle as recited in claim 1 wherein the piston is slidable in a bore of limited extent formed in the housing, one end of the bore being closed, while the other end opens into a vestibule, the valve seat being located generally axially of the bore on the opposite side of the vestibule, the inlet opening being located coaxially of the bore on the opposite side of the valve seat from the vestibule, the outlet opening being located non-coaxially of the bore on the end thereof opposite the vestibule, and wherein a generous passageway extends from the vestibule to the outlet opening and having a substantial portion that is parallel to and spaced from the bore.

5. Fire fighting nozzle as recited in claim 1, wherein the fluid at the inlet opening is a mixture of powder and a propellant gas, wherein the passage leading from the inlet opening to the pilot valve opens into an annular groove formed on the wall of the inlet opening, wherein a separating element covers the groove and consists of a sleeve having large apertures covered by a tubular screen having relatively small apertures.

6. Fire fighting nozzle, comprising
a. a housing,
b. a hand grip extending from the housing,
c. a pilot valve mounted in the hand grip with an actuating button extending from the hand grip in position for operation by a finger,
d. an inlet opening in the housing, p1 e. an outlet opening in the housing, f. a main valve located in the housing, the main valve comprising an axially-slidable piston having a first end of small area engaging a valve seat and a second end of relatively large area to which fluid from the inlet opening is admitted by the pilot valve, and g. passages connecting the inlet opening to the pilot valve and to the main valve, the pilot valve normally causing fluid from the inlet opening to maintain the main valve in a first condition wherein fluid cannot pass from the inlet opening to the outlet opening, the pilot valve on occasion allowing the main valve to move to a second condition wherein fluid is allowed to pass from the inlet opening to the outlet opening, the piston being slidable in a bore of limited extent formed in the housing, one end of the bore being closed, while the other end opens into a vestibule, the valve seat being located generally axially of the bore on the opposite side of the vestibule, the inlet opening being located coaxially of the bore on the opposite side of the valve seat from the vestibule, the outlet opening being located non-coaxially of the bore on the end thereof opposite the vestibule, and a generous passageway substantial portion that is parallel to and spaced from the bore.

7. Fire fighting nozzle as recited in claim 6, wherein the pilot valve consists of a spindle slidably carried in a bore in the hand grip, the spindle extending from the bore and from the grip to constitute the said actuating button.

8. Fire fighting nozzle as recited in claim 7, wherein a first passage extends from the inlet opening in the housing to the bore in the grip, a second passage extends from the bore in the grip to the said second end of the piston, and a third passage extending from the bore in the grip to the exterior of the grip.

9. Fire fighting nozzle as recited in claim 8, wherein the pilot valve spindle having two axially-spaced reduced portions, one of the reduced portions bridging the first and second passages when the pilot valve is in its normal condition, while the other reduced portion bridges the second and third passages when the pilot valve has its button depressed.

10. Fire fighting nozzle as recited in claim 6, wherein a tubular fluid distributor extends from the outlet opening of the housing in a direction generally perpendicular to the grip.

11. Fire fighting nozzle as recited in claim 6, wherein another set of inlet and outlet openings with a main valve is located in the housing in spaced, generally-parallel relationship to the aforementioned inlet opening, outlet opening, and main valve, and wherein a second pilot valve is mounted in the hand grip with its actuating button located adjacent the aforementioned actuating button.

12. Fire fighting nozzle as recited in claim 6, wherein the fluid at the inlet opening is a mixture of powder and a propellant gas, wherein the passage leading from the inlet opening to the pilot valve opens into an annular groove formed on the wall of the inlet opening, wherein a separating element covers the groove and consists of a sleeve having large apertures covered by a tubular screen having relatively small apertures.

13. Fire fighting nozzle, comprising a. a housing, b. a hand grip extending from the housing, c. a pilot valve mounted in the hand grip with an actuating button extending from the hand grip in position for operation by a finger, d. an inlet opening in the housing, e. an outlet opening in the housing, f. a main valve located in the housing, and g. passages connecting the inlet opening to the pilot valve and to the main valve, the pilot valve normally causing flud from the inlet opening to maintain the main valve in a first condition wherein fluid cannot pass from the inlet opening to the outlet opening, the pilot valve on occasion allowing the main valve to move to a second condition wherein fluid is allowed to pass from the inlet opening to the outlet opening, the fluid at the inlet opening being a mixture of powder and a propellant gas, the passage leading from the inlet opening to the pilot valve opening into an annular groove formed on the wall of the inlet opening, and a separating element covering the groove and consisting of a sleeve having large apertures covered by a tubular screen having relatively small apertures.

14. Fire fighting nozzle as recited in claim 13, wherein the main valve comprises an axially-slidable piston having a first end of small area engaging a valve seat and a second end of relatively large area to which fluid from the inlet opening is admitted by the pilot valve.

15. Fire fighting nozzle as recited in claim 14, wherein the pilot valve consists of a spindle slidably carried in a bore in the hand grip, the spindle extending from the bore and the grip to constitute the said actuating button.

16. Fire fighting nozzle as recited in claim 15, wherein a first passage extends from the inlet opening in the housing to the bore in the grip, a second passage extends from the bore in the grip to the said second end of the piston, and a third passage extending from the bore in the grip to the exterior of the grip.

17. Fire fighting nozzle as recited in claim 16, wherein the pilot valve spindle having two axially-spaced reduced portions, one of the reduced portions bridging the first and second passages when the pilot valve is in its normal condition, while the other reduced portion bridges the second and third passages when the pilot valve has its button depressed.

18. Fire fighting nozzle as recited in claim 13, wherein a tubular fluid distributor extends from the outlet opening of the housing in a direction generally perpendicular to the grip.

19. Fire fighting nozzle as recited in claim 13, wherein another set of inlet and outlet openings with a main valve is located in the housing in spaced, generally-parallel relationship to the aforementioned inlet opening, outlet opening, and main valve, and wherein a second pilot valve is mounted in the hand grip with its actuating button located adjacent the aforementioned actuating button.

20. Fire fighting nozzle as recited in claim 14, wherein the piston is slidable in a bore of limited extent formed in the housing, one end of the bore being closed, while the other end opens into a vestibule, the valve seat being located generally axially of the bore on the opposite side of the vestibule, the inlet opening being located coaxially of the bore on the opposite side of the valve seat from the vestibule, the outlet opening being located non-coaxially of the bore on the end thereof opposite the vestibule, and wherein a generous passageway extends from the vestibule to the outlet opening and having a substantial portion that is parallel to and spaced from the bore.

* * * * *